United States Patent [19]

Ostrowsky

[11] B 3,993,208

[45] Nov. 23, 1976

[54] SAFETY CLOSURE MEANS

[75] Inventor: Efrem M. Ostrowsky, Highland Park, Ill.

[73] Assignee: VCA Corporation, Baton Rough, La.

[22] Filed: Jan. 14, 1975

[21] Appl. No.: 541,015

[44] Published under the second Trial Voluntary Protest Program on January 27, 1976 as document No. B 541,015.

[52] U.S. Cl. ..... 215/216; 215/320

[51] Int. Cl.[2] ..... B65D 55/02

[58] Field of Search ..... 215/9, 216, 221

[56] References Cited

UNITED STATES PATENTS

| | | | |
|---|---|---|---|
| 3,854,622 | 12/1974 | McKirnan | 215/216 |
| 3,877,597 | 4/1975 | Montgomery | 215/216 |

*Primary Examiner*—George T. Hall

*Attorney, Agent, or Firm*—Donald L. Johnson; John F. Sieberth; E. Donald Mays

[57] ABSTRACT

Safety closure means comprising a container and a closure cap therefor, in which the container has a neck and a shoulder, which shoulder is formed with a pair of diametrically positioned locking lugs integrally formed therewith. The cap is formed of a thermoplastic material having a top end wall and a depending annular inner wall and a depending outer annular skirt spaced from the inner wall, with the inner wall of the cap having threaded means for engaging the neck of the container to secure the cap to the container in a closed position. The outer skirt of the cap has a pair of diametrically positioned radially extending locking lugs adjacent the lower end thereof integrally formed with said skirt, the cap locking lugs being adapted when the cap is rotated to cap closing position to pass inwardly of the container locking lugs and to be compressed radially inward during said passage, and as the cap lugs move past the container locking lugs the cap lugs will be released from their compressed state so that they extend outwardly beyond the engaging edges of the container locking lugs to lock therewith and prevent counter-rotation or unscrewing of the cap. The outer skirt of the cap is adapted to be manually engaged and pressed radially inward adjacent the cap locking lugs to permit the cap lugs to clear the engaging edges of the container lugs and ride inwardly of the inside surface of the container lugs when the cap is rotated in a counter-rotation to permit removal of the cap from the container neck.

12 Claims, 10 Drawing Figures

TO OPEN SQUEEZE CAP SIDES AND TURN

SAFETY CLOSURE MEANS

BRIEF DESCRIPTION OF THE INVENTION

It is well-recognized that access to certain materials such as detergents, insecticides and pharmaceuticals is potentially dangerous to children and when such material is contained in a container having a conventional closure cap a child could unscrew such a cap and gain access to the harmful material. Various attempts have been made to provide child-proof safety caps which will prevent or make it difficult for a child to unscrew the cap from a container.

One of the objects of this invention is to provide a safety cap and container having coacting elements whereby once the cap is applied to close the container it would be difficult if not impossible for a young child to apply the manual pressure at the pressure points for the purpose of releasing the cap from its engagement with the container, thereby preventing the child from gaining access to the contents of the container.

Another object of this invention is to provide a linerless safety cap of the foregoing character which seals the mouth of the container to prevent the leakage of the liquid within the container.

Another object of this invention is to provide a cap of the foregoing character which may be integrally molded of a thermoplastic material in an economical manner and in which the interengaging elements of the container may be molded as an integral part of the container, thus, providing a very simple and inexpensive structure with a great safety factor in connection with containers and closures therefor.

BRIEF DESCRIPTION OF THE DRAWINGS

In the drawings:

FIGS. 1 THROUGH 9

Figures 1, 2, 3, 4, 5, 6, 7, 8, 9, 10:
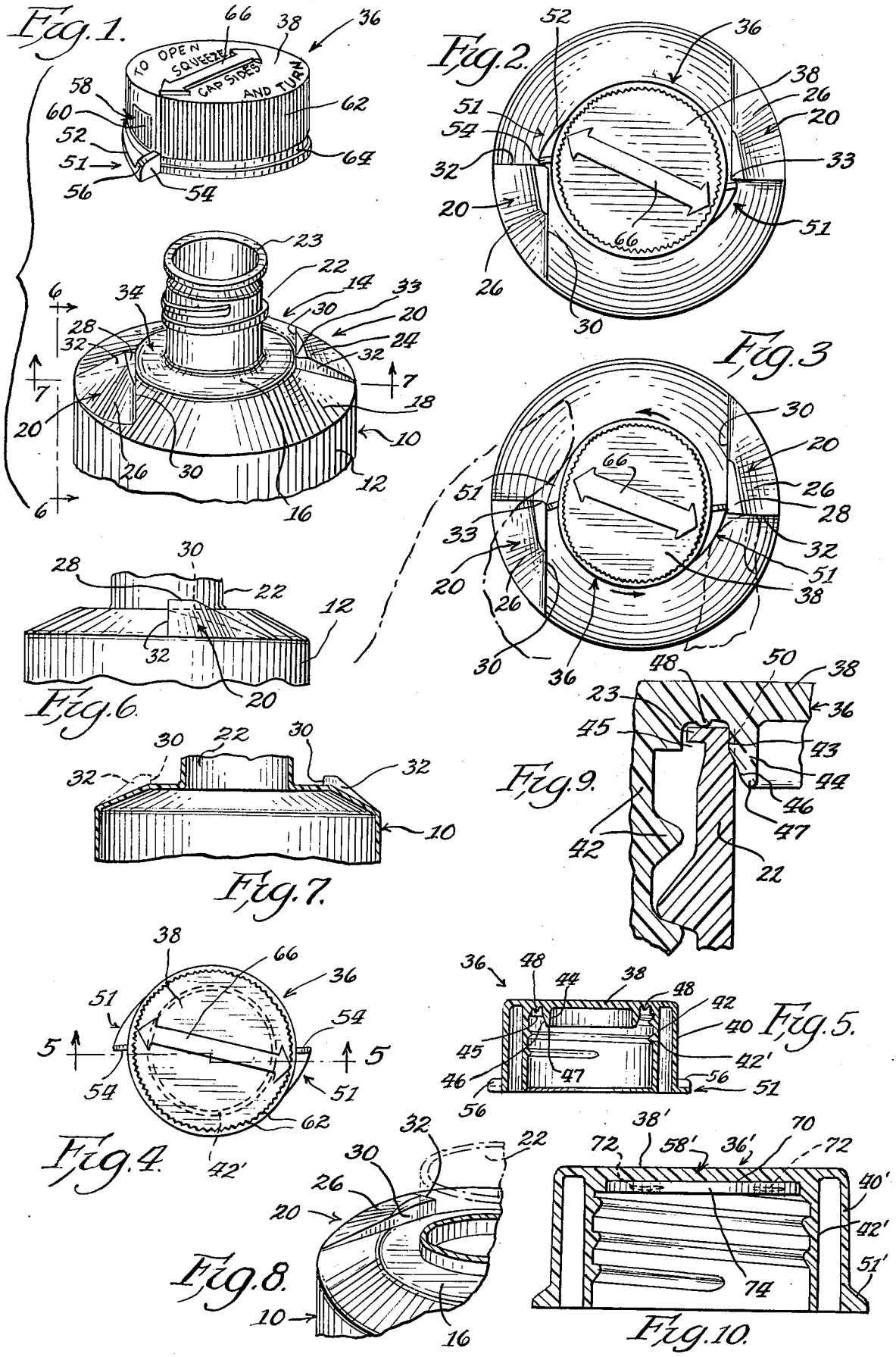
FIG. 1 is an exploded perspective view showing the cap and the upper portion of the container forming this invention.
FIG. 2 is a top plan view of the cap applied to the container with the cap in locked position to resist unscrewing of the cap by a child.
FIG. 3 is a view similar to FIG. 2 but showing the manual pressure applied radially inward by the fingers of the hand at the diametrically opposite points of the cap to permit the cap locking lugs to clear the container locking lugs to permit rotation of the cap in a counterclockwise rotation for unscrewing same from the container neck.
FIG. 4 is a top plan view of the cap.
FIG. 5 is a cross-sectional view taken on line 5—5 of FIG. 4, showing particularly a linerless cap.
FIG. 6 is an elevational view taken on line 6—6 of FIG. 1.
FIG. 7 is a sectional view taken on line 7—7 of FIG. 1.
FIG. 8 is a fragmentary perspective view showing particularly one of the container locking lugs as viewed from the inside thereof.
FIG. 9 is a fragmentary sectional view showing the linerless cap in a closed sealing position with respect to the lip of the container.
FIG. 10 is a sectional view of a modified cap with a liner used principally for non-liquids.

The construction shown in FIGS. 1 through 9 includes a linerless cap which is used principally in packaging liquids and will be first described.

The container generally indicated at 10 may be a blow-molded bottle or the like comprising a body 12 having a top shoulder generally indicated at 14, which shoulder includes an inner annular planar surface 16 and an outer annular downwardly inclined shoulder surface portion 18 on which the diametrically spaced container locking lugs generally indicated at 20 are formed and positioned. The container includes an externally threaded neck 22 having a top outwardly extending annular lip 23 at the mouth of the neck. The top of the lip has a planar surface.

Each of the diametrically positioned container locking lugs 20 comprises a raised upwardly extending projection 24 extending upwardly of said shoulder and said projection comprises an inclined or sloping top surface 26 which merges into a flat or planar surface 28 adjacent the inside front corner edges of said projection. Each lug has an inwardly facing vertical wall or flat side face forming the inside edge 30 of said lug and a front vertical wall or front flat face forming the front or engaging edge 32 of said lug, with the inside side edge 30 and front edge 32 generally perpendicular to each other. The corner 33 formed by the meeting of said side and front edges is immediately adjacent the planar surface 16 of the shoulder. The front edge 32 of each lug 20 is the edge which is engaged by the locking lugs on the cap to lock the cap against counterclockwise rotation, as will be subsequently described. A space 34 is provided between the inside side edge 30 and the neck of the container. The container and the locking lugs are all integrally formed.

The cap or closure member 36 is integrally molded of a thermoplastic material and comprises a top end wall 38, an outer annular skirt 40, and a spaced inner annular wall 42 spaced inwardly of the outer skirt and of substantially the same height. Depending from the underside of the top end wall 38 is an annular projection or ring 44 which is concentric with the inner wall 42 but spaced therefrom to provide an annular recess 45 therebetween. The exterior wall surface 43 of the ring 44 has a slight inwardly inclined taper. The exterior surface of the lower end of the annular projection or ring 44 has a greater inwardly inclined or tapering surface portion 46 terminating in a rounded bottom edge 47. The underside of the top or end wall 38 of the cap has an annular hump or bead 48 which is alined centrally with the recess 45.

As best seen in FIG. 9, when the cap is secured to the container and is in sealing position, the lip 23 of the neck 22 of the container is received within the annular recess 45, with the annular projection or ring 44 extending into the mouth of the container, with the upper exterior tapering portion 43 of the ring 44 bearing against the upper inner wall 50 adjacent the mouth of the container to seal the mouth of the container and to prevent any liquid from escaping. The annular projection or ring 44 in effect acts as a a cork or plug as it extends into the mouth of the container. The annular hump or bead 48 engages the top of the lip 23. There is thus provided a linerless cap which serves as an effective seal against leakage of the liquid within the container.

As will be hereinafter described in connection with the operation, the cap seals the mouth of the container when the cap is screwed on the neck of the container and the cap locking lugs 51 move past the container locking lugs to lock the cap against counterclockwise rotation. However, the cap can be rotated approximately through an arc of 90° forwardly or clockwise of the container locking lugs, thus, the cap 36 can be rotated counterclockwise this arc of 90° before the cap locking lugs are disengaged from the container locking lugs, and in this 90° arc the cap still remains in its sealing position, as described and as shown in FIG. 9.

The inner wall 42 of the cap has an internal thread 42' for engagement with the external thread of the neck 22 of the container. The outer skirt 40 of the cap has a pair of diametrically opposed radially extending cap lugs generally indicated at 51, each lug having a curved and outwardly inclined outer edge 52 which slopes or curves outwardly at the front from adjacent the skirt toward the other or rear end of said lug forming a camming surface and terminating at the rear of the lug in a vertically extending portion 54 which has an inclined or beveled surface 56 of approximately 45°. The cap lugs 51 form radial bottom lips and the bottom of each cap lug is flush with the bottom edge of the skirt. The rear vertically extending portion 54 of the cap locking lug 51 provides some rigidity to insure that the locking lug does not bend upward and jump over the container locking lugs when attempting to force counterclockwise rotation of the cap.

The outer skirt 40 is provided adjacent and upwardly of the radial lugs 51 with skirt surface areas indicated at 58, which surface areas are to be manually engaged by the fingers of the hand, as will be presently described. The manual pressure surface areas 58 are provided with a plurality of vertically extending spaced ribs 60 which terminate short of the top of the skirt. There are two such radial pressure points or surface areas on the cap in diametrically opposed positions. The balance of the outer skirt is provided with a surface different from the surface pressure points and same is formed by a continuous series of ribs 62 extending from the top wall but terminating short and spaced upwardly of the bottom edge to provide a smooth annular surface 64 adjacent the bottom of the cap which would be coextensive with the rear vertical wall 54 of the cap lug. Indicator arrows 66 are formed on the top wall of said cap with the arrows pointing to the pressure surface areas of the cap. Suitable instructions may be formed as part of the cap, such as shown in FIG. 1.

OPERATION

To secure the cap to the container the inside wall 42 is positioned over the neck of the container and the cap is rotated clockwise. As the cap rotates downwardly in relation to the neck into closing and sealing position, the radial cap lugs 51 will pass inside the side edges 30 of the container lugs within the space 34 and as the cap lugs 51 engage the side edges 30 of the container lugs and rotation is continued, the cap lugs 51 will be compressed at their widest point adjacent the rear of the cap lugs, as shown in FIG. 3, until each cap lug squeezes past the side edge or side wall 30 of the container lug 20, at which point the inward radial pressure against the cap lug is released and the cap lug assumes its normal position, as shown in FIG. 2, so that the rear edge 54 of the cap lug 51 abuts against the front edge 32 of the container lug. The cap in this position is in its fully closed and sealing position, although the cap may be rotated further clockwise through an arc of 90° forwardly of the container locking lugs 20. In any event, the cap is prevented from being rotated counterclockwise or unscrewed by virtue of the engagement of the cap locking lugs 51 with the container locking lugs 20, as seen in FIG. 2. The cap cannot be removed except by a person who has sufficient manual strength to radially compress the pressure sides or pressure space areas 58, as shown in FIG. 3, and this would preclude removal of the cap by a child.

When sufficient manual pressure is applied against the pressure areas 58 of the skirt of the cap, as indicated by the fingers in the arrowed lines in FIG. 3, the skirt of the cap is distorted so that the pressure areas of the skirt of the cap are pressed radially inward which simultaneously moves the cap locking lugs 51 inwardly of the inside side edges 30 of the container locking lugs 20 to thereby compress the cap locking lugs between the inner side edges 30 of the container lugs and the outer skirt of the cap so that they can ride past the inner side edges 30 of the cap locking lugs in a counterclockwise rotation. After the cap locking lugs are released from the container lugs during this counterclockwise rotation, the cap is then free to be unscrewed from the neck of the bottle. The curved side edge 52 of the cap lugs provides, in effect, a camming surface against the container lugs when the cap is rotated clockwise to effect a locking position. After the cap is rotated in counterclockwise direction past the container lugs the cap lugs will largely assume their normal noncompressed position.

The top planar surface 28 of the container lugs 20 will permit the bottom of the cap lugs to ride thereover when the cap is moving or being rotated into closure position and prior to the final rotation of the cap to its fully sealing position. However, such planar surface serves no purpose when the cap is being rotated counterclockwise to unscrew it since in such event the cap locking lugs 51 must pass inwardly of the side edges 30 of the container lugs 20.

When rotating the cap clockwise the sealing of the mouth of the container takes place just as the cap locking lugs 51 pass the container locking lugs 20, as shown in FIG. 9. While the cap can be rotated clockwise approximately through an additional arc of 90 degrees forwardly of the container locking lugs 20, the sealing of the container remains effective. In unscrewing the cap, the seal is maintained during the counterclockwise rotation of the cap through the 90 degree arc and not until the cap lugs 51 are disengaged from the container lugs 20 in the counterclockwise rotation of the cap is this closure seal broken. Thus, the cap may be freely rotated clockwise and counterclockwise through this arc of 90° without the unsealing of the cap in its closed sealing position.

FIG. 10

The modified cap shown in FIG. 10 is used principally in the packaging of non-liquid materials, such as pills or granular or powdered substances. The container and its locking lugs remain as previously described and likewise the exterior of the cap and its locking lugs remain as previously described and hence will not be redescribed. The only change made is in the interior of the underside of the cap, which changes will now be described.

The modified cap 36' has a top end wall 38' and an outer annular skirt 40' and a spaced inner annular wall 42' with cap locking lugs 51', all as previously described. The underside of the top end wall 38' has an annular recess 70 provided with spaced undercuts 72 which receive and hold a liner 74 secured to the underside of the cap. The lip 23 at the mouth of the container 10 engages the liner 74 to close the mouth of the container.

This invention is such that only an adult person with sufficient manual strength can compress the diametrically opposite sides of the cap to unscrew the cap and it would be impossible for a child to unscrew the cap. The manual pressure at the diametrically opposed pressure points should be adjacent the lower edge of the skirt around the area where the spaced ribs are positioned, for if pressure is applied adjacent the top of the cap it will not be sufficient to cause the lugs at the bottom to pass the container locking lugs. It would also be impossible for a child to unscrew the cap by placing the mouth end of the container in his mouth and biting on the cap to produce the pressure needed for the disengagement of the locking lugs.

The cap of this invention can be operated by a sightless person or one with poor vision as it is possible by feeling the radially extending cap lugs to know where to position the fingers of the hand to unscrew the cap.

What is claimed is:

1. Safety closure means comprising, a container and a closure cap therefor, said container having a neck and a shoulder, a locking lug on said shoulder, said cap having a top end wall and a depending annular inner wall and a depending outer annular skirt spaced from said inner wall, said inner wall having means engaging the neck of the container to secure said cap to said container in a closed position, said outer skirt having a radially extending locking lug adjacent the lower end thereof, said cap locking lug adapted when the cap is rotated to cap closing position to pass inwardly of said container locking lug and to be compressed radially inward during said passage and as it moves past the container locking lug to be released from its compressed state so that it extends outwardly beyond the engaging edge of said container locking lug to lock therewith and prevent counter-rotation of said cap, said outer skirt of said cap adapted to be manually engaged and pressed radially inward adjacent said cap locking lug to permit said cap lug to clear the engaging edge of the container lug and ride inwardly of the inside surface of said container lug when the cap is rotated in counter-rotation to permit removal of the cap from the container neck.

2. The structure as set forth in claim 1 in which there is a plurality of spaced container locking lugs engaged by a plurality of cap lugs.

3. The structure as set forth in claim 1 in which the cap is formed of a thermoplastic material and in which there is a pair of diametrically spaced container locking lugs engaged by a pair of diametrically spaced cap lugs and in which manual pressure is applied at such diametrically spaced portions of said cap.

4. The structure as set forth in claim 1 in which the neck of the container has a threaded portion and in which the inner wall of the cap is threaded for threaded engagement with the threaded neck and in which the cap is rotated clockwise for cap closing position and rotated counterclockwise to unscrew the cap, and in which the cap locking lug has an outer surface with a radius which increases from the front to the rear with the rear abutting adjacent the front edge of the container locking lug for locking the cap.

5. The structure as set forth in claim 4 in which the cap locking lug extends radially outward of the cap to form a bottom lip adjacent the bottom of the skirt of the cap and in which the rear edge of said cap locking lug extends upward of said lip.

6. The structure as set forth in claim 1 in which there is a pair of diametrically spaced container locking lugs engaged by a pair of diametrically spaced cap lugs and in which manual pressure is applied at such diametrically spaced portions of said cap, and in which the neck of the container has a threaded portion, and in which the inner wall of the cap is threaded for threaded engagement with the threaded neck, and in which the cap is rotated clockwise for cap closing position and rotated counterclockwise to unscrew the cap, and in which the cap locking lug has an outer surface with a radius which increases from the front to the rear with the rear abutting adjacent the edge of the container locking lug for locking the cap, and in which the cap locking lug extends radially outward of the cap as a lip adjacent the bottom of the skirt of the cap and in which the rear edge of said cap locking lug extends upward of said lip to provide a degree of rigidity to said lip.

7. The structure as set forth in claim 1 in which the container locking lug has an inside edge which is substantially perpendicular to the front edge of the lug.

8. The structure as set forth in claim 3 in which the top of each said container lug has a planar surface adjacent the front corner inner edge thereof.

9. The structure as set forth in claim 1 in which the cap is a linerless cap in which the inside of the top end wall of the cap is provided with an annular projection or ring spaced inwardly of the inner wall and providing an annular recess between the inner wall and the ring to receive the annular lip at the mouth edge of the neck of the container, and in which the ring extends into the mouth of the container to serve as a plug for sealing the mouth of the container to prevent leakage of any liquid within the container.

10. The structure as set forth in claim 9 in which the exterior surface of the ring has an inwardly inclined tapering surface for engagement with the inside of the mouth of the container.

11. The structure as set forth in claim 9 in which the cap can be freely rotated through an arc of approximately 90 degrees in a clockwise direction after the cap locking lugs engage the container locking lugs in locking position, and in which the cap can be rotated counterclockwise said 90 degrees without effecting disengagement of said locking lugs and still maintain said ring in sealing position in the mouth of said container.

12. The structure as set forth in claim 1 in which the cap supports a liner on the underside of the top end wall of the cap, which liner engages the mouth of the container to close said container.

* * * * *